US007465161B2

(12) United States Patent
Schulze et al.

(10) Patent No.: US 7,465,161 B2
(45) Date of Patent: Dec. 16, 2008

(54) DEVICE FOR COMPRESSING CONCRETE DURING THE MANUFACTURE OF CONCRETE PARTS

(75) Inventors: Richard Schulze, Munich (DE); Holger Muth, Kirchheim-Heimstetten (DE)

(73) Assignee: Wacker Construction Equipment AG, Munich (DE)

( * ) Notice: Subject to any disclaimer, the term of this patent is extended or adjusted under 35 U.S.C. 154(b) by 172 days.

(21) Appl. No.: 10/597,766

(22) PCT Filed: Feb. 4, 2005

(86) PCT No.: PCT/EP2005/001183

§ 371 (c)(1),
(2), (4) Date: Aug. 7, 2006

(87) PCT Pub. No.: WO2005/075166

PCT Pub. Date: Aug. 18, 2005

(65) Prior Publication Data

US 2007/0166427 A1 Jul. 19, 2007

(30) Foreign Application Priority Data

Feb. 6, 2004 (DE) ..... 10 2004 005 922

(51) Int. Cl.
*B28B 1/087* (2006.01)

(52) U.S. Cl. ..... 425/211; 425/432

(58) Field of Classification Search ..... 425/432, 425/456, 472, 211

See application file for complete search history.

(56) References Cited

U.S. PATENT DOCUMENTS 6,152,722 A * 11/2000 Sick et al. ..... 425/432

FOREIGN PATENT DOCUMENTS

| | | | |
|---|---|---|---|
| DE | 6926530 | U | 1/1970 |
| DE | 3427780 | A1 | 1/1986 |
| DE | 196 31 516 | A1 | 2/1998 |
| EP | 1 293 314 | A2 | 3/2003 |
| JP | 09 234714 | A | 9/1997 |

* cited by examiner

*Primary Examiner*—James Mackey
(74) *Attorney, Agent, or Firm*—Boyle Fredrickson, S.C.

(57) ABSTRACT

The invention relates to a device for compressing concrete during the manufacture of concrete parts. Said device comprises a supporting structure, a formwork device which is maintained by the supporting structure and a vibration decoupling device which is arranged between the supporting structure and formwork device. The vibrations required to compress concrete are produced by a vibration device acting directly upon the formwork device. In order to reduce noise emission, the mass of the supporting structure is selected in such a way that the intrinsic frequency of a system consisting of the supporting structure and vibration decoupling device is lower than the excitation frequency of the vibration device. Preferably, the formwork device, vibration decoupling device, vibrators and all electrical feed lines and connections are premounted, forming a module which can then be mounted on the supporting structure.

17 Claims, 1 Drawing Sheet

DEVICE FOR COMPRESSING CONCRETE DURING THE MANUFACTURE OF CONCRETE PARTS

BACKGROUND OF THE INVENTION

1. Field of the Invention

According to the preamble of patent claim 1, the present invention relates to a device for compacting concrete during the manufacture of concrete parts. In addition, according to patent claim 10 the present invention relates to a module intended for installation in such a device.

2. Description of the Related Art

In the manufacture of concrete parts, the formwork elements in the concrete works are standardly situated on vibrating tables that are used to compress the concrete, which is cast using the formwork elements in order to give it shape. Such a vibrating table is standardly made of a bearing structure made of steel bearers and a steel, wood, or plastic plate (formwork) that acts as a table plate or formwork shell and is held by the bearing structure. The vibrating tables are equipped with an exciter device in the form of several vibration exciters, in particular external vibrators, distributed over the bearing structure, which can set the bearing structure made up of the steel bearers, and thus also the formwork, into vibration. After the building up of the additional formwork elements on the vibrating plate and the casting of the fresh concrete into the formwork elements, as well as into the reinforcements often inserted therein, the vibration exciters are set into motion, which causes complex forms of vibration in the bearing structure and in particular in the vibrating table plate, resulting in a compressing of the concrete. The bearing structure that supports the vibrating table plate is excited by the external vibrator attached thereto, as is the table plate. This results in jarring contacts between parts of the bearing structure, as well as a complex transmission and propagation of sound into the air, which can significantly worsen the working conditions for the workers at the site.

In order in particular to reduce the high sound level in concrete parts manufacturing works that use vibrating tables operated with external vibrators, from DE 196 31 516 A1 it is known to attach the vibration exciters, i.e. the external vibrators, directly to the actual formwork, i.e., the table surface. The formwork is decoupled from the bearing structure that bears it by a vibration decoupling device, i.e., elastic constructive elements such as e.g. springs, rubber elements, or a layer of foam. This reduces the required vibrational energy, and the vibrations of the bearing structure are reduced. The result is a significantly reduced noise emission of the device during the compressing of concrete.

The bearing structure is standardly made up of a plurality of steel bearers onto which the vibration decoupling device and finally the formwork device are subsequently fastened. This requires a significant expense on-site during the assembly of the device.

In EP 1 293 314 A2, a device is described for compressing concrete during the manufacture of concrete parts. The resonant vibrations of the system are taken into account during the setting of the excitation frequency and the excitation force.

In DE 34 27 780 A1, a device is disclosed for compressing and manufacturing concrete parts in which a shell surface is elastically supported. Here, the operating frequency of a vibration exciter can be set in such a way that it is located in the vicinity of a resonant frequency of the shell surface.

From DE 69 26 530 U, a vibration table for compressing concrete samples is known in which rubber-metal buffers are provided between the table plate and the foundation.

JP 09234714 A discloses a device for manufacturing concrete parts in which a vibration exciter is capable of being connected to a formwork device having a voltage supply.

OBJECT OF THE INVENTION

The object of the present invention is to improve a device, known from the prior art, for compressing concrete during the manufacture of concrete parts with respect to noise emission and assembly expense.

According to the present invention, this object is achieved by a device according to Claim 1, and by a module according to Claim 10 that is intended for installation in such a device. Advantageous further developments of the present invention are defined in the dependent claims.

A device according to the present invention for compressing concrete during the manufacture of concrete parts has a bearing structure, a formwork device held by the bearing structure, and a vibration decoupling device provided between the bearing structure and the formwork device. At least one vibration exciter, e.g. an external vibrator, is provided in such a way that it acts directly on the formwork device. The device is characterized in that an excitation frequency of the vibration exciter is not located in the range of a resonant frequency of a system made up of the bearing structure and the vibration decoupling device.

In general, the bearing structures in such devices for compressing concrete are flexible with respect to the vibration frequency of the vibration exciter. It has turned out that despite the use of the vibration decoupling device (e.g. using spring elements or a layer of foam) to decouple the excited formwork, the bearing structure is excited to vibrations when it has resonant frequencies (resonant frequencies) that are in the area of the excitation frequency of the vibration exciter. This results in undesired noise emissions. Due to the fact that an effort is made to separate the excitation frequency of the vibration exciter and the resonant frequency of the system made up of the bearing structure and the vibration decoupling device, such an interaction effect can be avoided.

For this purpose, first an excitation frequency for the vibration exciter is selected that is recognized as advantageous for the compressing of the concrete. The bearing structure must then be constructed in such a way that its resonant frequency, resulting from the mass of the bearing structure and the spring rigidity of the vibration decoupling device, is as far as possible from the excitation frequency.

It is particularly advantageous for the excitation frequency to be greater than the resonant frequency of the system made up of the bearing structure and the vibration decoupling device. In particular, the excitation frequency should be at least twice as great as the resonant frequency in order to ensure a sufficient decoupling.

The idea that forms the basis of the present invention is to keep the gain factor of the overall system, i.e. the ratio of the output amplitude (vibration amplitude of the bearing structure) and the input amplitude (excitation amplitude, vibration amplitude of the formwork device) as low as possible. If the excitation frequency is significantly higher than the resonant frequency of the bearing structure, the gain factor goes to zero, i.e., the bearing structure is mechanically decoupled. Noise emissions are also reduced to the extent that the bearing structure is decoupled from the vibration excitation, and thus does not vibrate along with it.

In order to obtain a sufficient decoupling by separating the excitation frequency from the resonant frequency, it is particularly advantageous if the bearing structure is provided with as great a mass as possible. The greater the mass of the bearing structure, the lower is its resonant frequency. Here, "greatest possible mass" is to be understood as a mass that someone skilled in the art will consider practicable on the basis of the site conditions, constructive expense, and size of the formwork device. In any case, an attempt should be made to make the mass of the bearing structure as great as possible within the existing boundary conditions. Because, as explained above, the excitation frequency is essentially determined by the desired concrete compression, the excitation frequency cannot be modified much. Thus, attention should primarily be focused on modifying the resonant frequency of the bearing structure.

In order to provide the bearing structure with a correspondingly large mass, it is particularly advantageous if the bearing structure is essentially formed by a concrete base. Concrete is not only heavy, but is also relatively economical in relation to its mass. It is thus easily possible to provide the bearing structure with sufficient mass.

In a particularly advantageous embodiment of the present invention, the bearing structure is decoupled from the ground that supports it in terms of vibration. For example, a soft intermediate layer can be provided between the bearing structure and the floor. In this way, it is possible to decouple the bearing structure from the surrounding building structures, e.g. the floor, the walls, and the foundation. This enables an additional noise reduction.

A module according to the present invention for installation in a device for compressing concrete during the manufacture of concrete parts is defined in Claim 10.

The module has a formwork device, a vibration decoupling device fastened to the formwork device, and at least one vibration exciter fastened to the formwork device.

While in the prior art, e.g. in the device known from DE 196 31 516 A1, the formwork device in the form of a viscoelastic intermediate layer, is merely inserted between the formwork device (formwork shell) and the bearing structure, in the module according to the present invention the vibration decoupling device is fastened to the formwork device. In this way, it is possible to pre-assemble the entire module at the manufacturing works; i.e., it is possible in particular also to fasten the vibration exciter, in addition to the vibration decoupling device, to the formwork device. In this way, the expense of the final assembly in the concrete part manufacturing works can be significantly reduced.

Preferably, the electrical supply lines for the vibration exciter are also already fastened completely to the formwork device. The supply lines can for example run between the vibration decoupling device and the formwork device, and can thus be held on the formwork device by the vibration decoupling device.

It is particularly advantageous if the vibration decoupling device has a layer of foam, and the electrical supply lines run inside the foam layer. The supply lines are then decoupled in terms of vibration from the formwork device, although they are borne by it.

In a preferred specific embodiment of the present invention, an electrical connecting device is fastened to the formwork device, so that the electrical supply lines can be coupled to an electrical supply network, e.g. a 250V or 42V network available in concrete part works. For this purpose, it is useful if a central plug connector is provided on the connecting device in order to couple the connecting device to the electrical supply network. The supply network can also have as a component a mobile power supply device, e.g. a portable frequency transformer.

The electrical connecting device should also be decoupled from the formwork device in terms of vibration, in order to avoid an unnecessarily high degree of mechanical stress.

The module according to the present invention can thus be assembled, including the electrical equipment, completely in the manufacturing works. At the recipient, i.e. in the concrete part manufacturing works, the module need then merely be placed on a bearing structure present there, e.g. a concrete base. The single electrical connection operation then takes place on location, in that the central plug connector is connected to the supply network by simply plugging it into a socket. The module according to the present invention thus enables what is known as a "plug-and-play" solution, by which the recipient's assembly costs on location can be significantly reduced.

These and additional features and advantages of the present invention are explained in more detail below on the basis of an exemplary embodiment, illustrated by the FIGURE.

DETAILED DESCRIPTION OF THE PREFERRED EMBODIMENT

Figure 1:
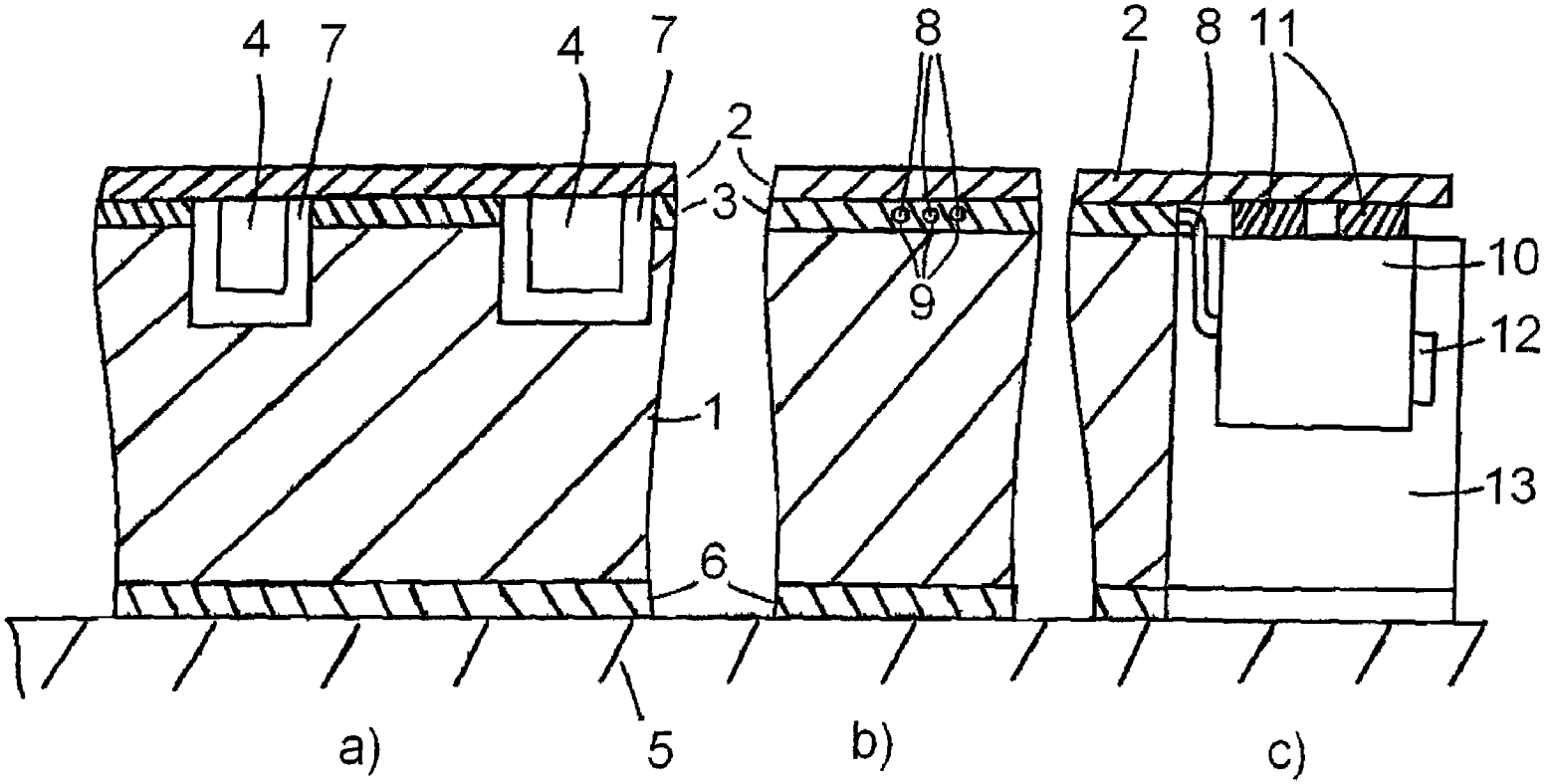
FIG. 1 shows a device according to the present invention for compressing concrete, in three schematic, partially sectional views a) to c), taken along a length of the device.

In practice, the device according to the present invention is also often called a vibrating table. Formwork elements (not shown in the FIGURE) can be built up on the vibrating table that are used to shape the concrete part that is to be manufactured. The formwork elements can be combined arbitrarily in a known manner, so that a more detailed description here is not required.

A component of the vibrating table is a bearing structure 1 that holds a formwork device 2. Here the table surface or table plate or formwork shell is to be regarded as formwork device 2, which is thus also a component of the overall formwork (made up of table plate/formwork device 2 and the above-described additional formwork elements). The fresh concrete is poured in above formwork device 2.

Between formwork device 2 and bearing structure 1, a foam layer 3, which acts as a vibration decoupling device, is provided. Foam layer 3 is preferably a viscoelastic layer that can for example also be made of a gradient material and that is relatively flexible on its side facing formwork device 2, in order to promote the propagation of vibrations in formwork device 2, and, in contrast, has damping and plastic properties on its other side, facing bearing structure 1, in order largely to prevent the solidborne transmission of sound to bearing structure 1. However, in principle many other materials that enable a vibration decoupling are suitable for the vibration decoupling device. In addition, it is not necessary for the vibration decoupling device to be fashioned in the form of foam layer 3. Instead, for example individual rubber elements or spring elements can also be used.

Foam layer 3 can simply be inserted between bearing structure 1 and formwork device 2. However, it is particularly advantageous if foam layer 3 is glued to the underside of formwork device 2. This enables pre-assembly at the manufacturing works of the device, reducing the expense of the final assembly at the concrete part manufacturing works.

On formwork device 2, on the side facing away from the concrete at least one, but preferably a plurality of vibration exciters 4 are attached. Vibration exciters 4 are preferably known external vibrators whose design and manner of operation need not be described in more detail here.

From the prior art, it is known to assemble the bearing structure as a static structure made of steel bearers. In the specific embodiment of the present invention shown in the FIGURE, however, bearing structure 1 is realized as a massive concrete base. Thus, steel bearers are not present. The concrete base can be manufactured on location in the concrete parts manufacturing works, because the fresh concrete required for the manufacture is already present in the works, so that transportation of the concrete base or of the concrete is not necessary. This can provide a noticeable reduction in the cost of the overall system.

Bearing structure 1 stands on a floor 5 of the building in which the device is constructed. For additional vibration decoupling, a vibration decoupling layer 6 is provided between bearing structure 1 and floor 5. This can also be a foam layer or a rubber layer that prevents transmission of the vibrations present in bearing structure 1 to floor 5 and thus into the surrounding building. Instead of vibration decoupling layer 6, corresponding spring foundations can also be used, by which a vibration decoupling between bearing structure 1 and floor 5 can be made almost complete.

On the upper side of bearing structure 1, recesses 7 are provided into which vibration exciters 4 can be placed. In this way, vibration exciters 4 are hermetically sealed from the surrounding environment, so that the noise that they emit cannot radiate to the environment. If necessary, ventilation or cooling of the drive mechanisms of vibration exciters 4 must be ensured.

The excitation frequency that is to be produced by vibration exciters 4 is preset on the basis of the desired degree of concrete compression. In many cases, the exciter drive mechanisms are already designed in such a way that they automatically achieve a suitable rotational speed and thus a suitable excitation frequency. The excitation frequency is standardly also capable of being modified during the operation of the device, and is standardly between 85 and 100 Hz.

In order to achieve a decoupling in terms of vibration of bearing structure 1 from the excited vibration of formwork device 2, according to the present invention care is to be taken that the resonant frequency of a system made up of bearing structure 1 and foam layer 3 does not coincide with the excitation frequency of vibration exciter 4. Rather, the excitation frequency should be significantly higher than the resonant frequency; the ratio between the excitation frequency and the resonant frequency should be greater than 2.0.

In order to achieve the resulting resonant frequency of bearing structure 1, it is necessary to provide bearing structure 1 with a correspondingly high mass. This is because the resonant frequency decreases as the mass increases. The frequency is determined by the [square] root of the quotient of the spring rigidity of foam layer 3 and the mass of bearing structure 1. Bearing structure 1, in particular its mass, is thus designed such that the resulting resonant frequencies of the overall system made up of the bearing structure and the vibration decoupling device (foam layer 3) are far enough below the excitation frequency that a good mechanical decoupling, i.e. a low gain factor, is provided, and the sound emission of the overall device is greatly reduced thereby. In practice, it has been possible to achieve a mass for the concrete base of bearing structure 1 that ensures a resonant frequency of 27 Hz. To achieve this, a specific mass of approximately 900 $kg/m^2$ was realized for the concrete base of bearing structure 1. Thus, in this example the ratio of the excitation frequency to the resonant frequency is 3.7, i.e., is significantly greater than the required value of 2.0.

In the partial section b) shown in the FIGURE, a section through the device is shown in which electrical supply lines 8 can be seen. Electrical supply lines 8 provide electrical power to vibration exciter 4. They are routed directly in foam layer 3, and are thus fastened to formwork device 2 with the aid of foam layer 3.

Electrical supply lines 8 can also be attached directly to formwork device 2. However, the noise reduction is improved if supply lines 8 are embedded in foam layer 3. Due to the fact that electrical supply lines 8 are routed inside foam layer 3, they cannot cause any clattering noises. Additional cable feedthroughs in bearing structure 1, or cable fastening devices, are not required.

For easier assembly, foam layer 3 is provided at the corresponding points with slots 9 into which electrical supply lines 8 can be pressed. Supply lines 8 are then fixed positively and/or non-positively in the groove following slots 9.

At the latest when formwork device 2 is placed on bearing structure 1, electrical supply lines 8 are also fixed in place and can no longer fall out of slots 9.

At a location in the device, an electrical connecting device in the form of a terminal box 10 is fastened to formwork device 2 (partial section c) in the FIGURE). In order to ensure vibrational decoupling, rubber elements 11 are provided between terminal box 10 and formwork device 2. All electrical supply lines 8 for the various vibration exciters 4 proceed from terminal box 10; supply lines 8 are routed in the manner shown at the top on the basis of partial section b).

On terminal box 10, a central plug connector 12 is provided at which the overall device can be connected to a stationary supply network present in the concrete parts manufacturing works. Instead of the plug connector 12, other known connection possibilities are of course also suitable. Alternatively to the supply network, plug connector 12 can also be connected to a mobile power supply device, e.g. a portable frequency transformer.

In order to create sufficient space for terminal box 10, an additional recess 13 is provided in bearing structure 1.

Significant parts of the device are already pre-assembled in the form of a module at the time of delivery to the concrete parts manufacturing works. For this purpose, vibration exciters 4 together with foam layer 3 are already fastened to formwork device 2. Via supply lines 8, vibration exciters 4 are completely electrically connected, and are connected to terminal box 10, which is likewise already fastened to formwork device 2 via rubber elements 11. The module thus forms a fully assembled unit that is in principle capable of functioning.

Thus, with the aid of the module it is possible to mechanically and electrically pre-assemble almost the entire device according to the present invention, and to deliver it in the pre-assembled state to the recipient, i.e., the concrete parts manufacturing works. There, the module need merely be placed onto bearing structure 1, which has been manufactured on-site from concrete in a particularly simple manner. After the module has been placed on bearing structure 1, the supply network need merely be connected to central plug connector 12. The assembly expense at the recipient can thus be reduced to a minimum. With the aid of the present invention, a "plug-and-play" solution is provided that is suitable for providing a drastic reduction of the expense during installation and commissioning of the low-noise vibration table.

We claim:

1. A module for installation in a device for compressing concrete, comprising:

a formwork device;

a vibration decoupling device fastened to the formwork device;

at least one vibration exciter fastened to the formwork device; and electrical supply lines for the vibration exciter or exciters, the electrical supply lines being fastened to the formwork device and being held on the formwork device by the vibration decoupling device.

2. The module as recited in claim 1, wherein the electrical supply lines run between the vibration decoupling device and the formwork device.

3. The module as recited in claim 1, wherein the vibration decoupling device has a foam layer, and the electrical supply lines run inside the foam layer.

4. The module as recited in claim 1, wherein an electrical connecting device is fastened to the formwork device for coupling the electrical supply lines to an electrical supply network.

5. The module as recited in claim 4, wherein on the connecting device a central plug connector is provided for coupling to the supply network.

6. The module as recited in claim 4, wherein the electrical supply lines between the connecting device and the vibration exciter are fastened completely to the formwork device.

7. The module as recited in claim 4, wherein the electrical connecting device is decoupled in terms of vibration from the formwork device.

8. A device for compressing concrete during the manufacture of concrete parts, wherein a module is provided that includes:

a formwork device;

a vibration decoupling device fastened to the formwork device;

at least one vibration exciter fastened to the formwork device; and electrical supply lines for the vibration exciter, the electrical supply lines being fastened to the formwork device and being held on the formwork device by the vibration decoupling device;

the formwork device, the vibration decoupling device, and the vibration exciter being completely pre-assembled to form the module; and wherein the pre-assembled module is capable of being placed onto a bearing structure.

9. The device as recited in claim 8, wherein recesses are provided in the bearing structure for accepting the vibration exciter or exciters.

10. A device for compressing concrete during the manufacture of concrete parts, comprising:

a bearing structure;

a formwork device held by the bearing structure;

a vibration decoupling device provided between the bearing structure and the formwork device;

at least one vibration exciter that acts directly on the formwork device; in which an excitation frequency produced by the vibration exciter is a frequency that is advantageous for the concrete compressing; and a system made up of the bearing structure and the vibration decoupling device is designed in such a way that its resonant frequency is not situated in the range of the excitation frequency; wherein the formwork device, the vibration decoupling device, and the vibration exciter are combined to form a pre-assembled module and;

the module is capable of being placed onto the bearing structure.

11. The device as recited in claim 10, wherein the resonant frequency of the system made up of the bearing structure and the vibration decoupling device is less than the excitation frequency of the vibration exciter.

12. The device as recited in claim 10, wherein the resonant frequency is at most half as large as the excitation frequency.

13. The device as recited in claim 10, wherein the bearing structure is provided with a mass that is selected to provide a resulting resonant frequency that is less than or equal to about half of the exciter frequency.

14. The device as recited in claim 10, wherein the bearing structure is formed at least essentially by a concrete base.

15. The device as recited in claim 10, wherein the bearing structure is decoupled in terms of vibration from a floor that supports the device.

16. The device as recited in claim 10, wherein a vibration decoupling layer is provided between the bearing structure and a floor and attenuates transmission of vibrations between the bearing structure and the floor.

17. The device as recited in claim 10, wherein recesses are provided in the bearing structure for accepting the vibration exciter or exciters.

* * * * *